US010184157B2

(12) United States Patent
Holly et al.

(10) Patent No.: US 10,184,157 B2
(45) Date of Patent: Jan. 22, 2019

(54) SELECTIVE ANNEALING PROCESS FOR PERFORATION GUNS

(71) Applicant: Halliburton Energy Services, Inc., Houston, TX (US)

(72) Inventors: Mark S. Holly, Ibrahim (SG); Wei Zhang, Houston, TX (US); Muralidhar Seshadri, Stafford, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 15/039,829

(22) PCT Filed: Dec. 31, 2013

(86) PCT No.: PCT/US2013/078490
§ 371 (c)(1),
(2) Date: May 26, 2016

(87) PCT Pub. No.: WO2015/102620
PCT Pub. Date: Jul. 9, 2015

(65) Prior Publication Data

US 2017/0028437 A1 Feb. 2, 2017

(51) Int. Cl.

| | |
|---|---|
| ***E21B 43/116*** | (2006.01) |
| ***C21D 1/30*** | (2006.01) |
| ***C21D 7/06*** | (2006.01) |
| ***B05D 3/06*** | (2006.01) |
| ***B05D 1/02*** | (2006.01) |
| ***F42D 1/02*** | (2006.01) |
| ***F42D 1/22*** | (2006.01) |

(52) U.S. Cl.
CPC ..... *C21D 1/30* (2013.01); *B05D 3/06* (2013.01); *C21D 7/06* (2013.01); *E21B 43/116* (2013.01); *F42D 1/02* (2013.01); *F42D 1/22* (2013.01); *B05D 1/02* (2013.01); *B05D 2202/00* (2013.01)

(58) Field of Classification Search
CPC ..... E21B 43/11–43/1195; C21D 1/30; C21D 7/06; B05D 3/06; F42D 1/22; F42D 1/02
See application file for complete search history.

(56) References Cited

U.S. PATENT DOCUMENTS 3,429,384 A 2/1969 Shore
4,534,423 A * 8/1985 Regalbuto ..... F42B 3/08 166/297
4,621,396 A 11/1986 Walker et al.
(Continued)

OTHER PUBLICATIONS

International Search Report and Written Opinion of PCT Application No. PCT/US2013/078490 dated Sep. 29, 2014: pp. 1-13.
(Continued)

*Primary Examiner* — Blake E Michener
(74) *Attorney, Agent, or Firm* — Chamberlain Hrdlicka

(57) ABSTRACT

A process for manufacturing a perforation gun casing includes providing a perforation gun housing that has a wall of nominal thickness and at least one scallop. Each scallop is a portion of the wall having a reduced thickness relative to the nominal wall thickness. The process also includes applying a selective annealing process to the perforation gun casing. The selective annealing process affects the material properties of the scallop but generally does not substantially affect the material properties of the portions of the wall having a nominal thickness.

19 Claims, 5 Drawing Sheets

(56) References Cited

U.S. PATENT DOCUMENTS

| | | | | |
|---|---|---|---|---|
| 4,773,299 | A * | 9/1988 | Oestreich | E21B 43/117 102/310 |
| 6,464,019 | B1 | 10/2002 | Werner et al. | |
| 6,523,474 | B2 | 2/2003 | Parrott et al. | |
| 6,536,237 | B1 | 3/2003 | Jung | |
| 6,702,039 | B2 | 3/2004 | Parrott et al. | |
| 6,865,792 | B2 * | 3/2005 | Kash | E21B 43/117 166/297 |
| 6,865,978 | B2 | 3/2005 | Kash | |
| 6,941,871 | B2 | 9/2005 | Mauldin | |
| 7,246,548 | B2 | 7/2007 | Kash | |
| 7,430,965 | B2 * | 10/2008 | Walker | E21B 43/117 102/310 |
| 7,621,342 | B2 * | 11/2009 | Walker | E21B 43/117 102/310 |
| 8,356,666 | B2 * | 1/2013 | Walker | E21B 43/117 166/277 |
| 9,027,456 | B2 * | 5/2015 | Mhaskar | E21B 43/117 89/1.151 |
| 9,238,956 | B2 * | 1/2016 | Martinez | E21B 43/117 |
| 2002/0134585 | A1 * | 9/2002 | Walker | E21B 43/117 175/4.51 |
| 2002/0189483 | A1 * | 12/2002 | Parrott | E21B 43/117 102/312 |
| 2003/0029639 | A1 * | 2/2003 | Parrott | B21C 1/22 175/4.6 |
| 2004/0211565 | A1 * | 10/2004 | Kash | E21B 43/117 166/297 |
| 2004/0216866 | A1 | 11/2004 | Barlow et al. | |
| 2005/0139352 | A1 * | 6/2005 | Mauldin | E21B 43/116 166/55 |
| 2005/0199032 | A1 | 9/2005 | Krajewski | |
| 2007/0079966 | A1 | 4/2007 | George et al. | |
| 2008/0223099 | A1 * | 9/2008 | David | B24C 1/10 72/53 |
| 2010/0276144 | A1 | 11/2010 | Hetz et al. | |
| 2010/0300750 | A1 | 12/2010 | Hales et al. | |
| 2011/0011148 | A1 | 1/2011 | Chen et al. | |
| 2011/0272134 | A1 * | 11/2011 | Roy | C21D 1/613 166/55.2 |
| 2013/0000472 | A1 * | 1/2013 | Mhaskar | E21B 43/117 89/1.151 |
| 2017/0081948 | A1 * | 3/2017 | Balun | E21B 43/116 |

OTHER PUBLICATIONS

De Kock, "Laser Heat Treating," Industrial Heating, Oct. 2001: pp. 1-4, <www.industrialheating.com>.

* cited by examiner

SELECTIVE ANNEALING PROCESS FOR PERFORATION GUNS

1. FIELD OF THE INVENTION

The present disclosure relates generally to methods for manufacturing perforation guns for use in the formation of hydro-carbon producing wells, and more specifically to methods and systems for selectively annealing portions of a perforation gun housing to improve the mechanical properties of the housing and performance of the housing during and after detonation.

2. DISCUSSION OF THE RELATED ART

In the early stage of developing a well, a drilling string is deployed into a hydrocarbon-producing formation to remove material to form a wellbore. Following completion of the wellbore, a casing may be installed in the wellbore to convey fluids from the formation to the surface where it is collected for production. The casing may be formed by connecting together a series of metal tubes or casing segments that are lowered into the wellbore to reinforce the wellbore to prevent collapse and to form a fluid flow path for conveying fluids to the surface. Once the casing is cemented in place in the wellbore, openings may be formed in the metal tubing in portions of the casing that are adjacent the hydrocarbon-producing formation to allow fluids to flow into the casing from the formation and up toward the surface of the well.

The aforementioned openings may also be referred to as "perforations", and may be formed by deploying a perforation gun into the portion of the casing that is to be perforated. The perforation gun may include a series of shaped charges that are detonated to generate an explosion into the casing and formation to provide a plurality of openings in the casing and tunnels in the formation that allow fluid to flow from the formation into the casing and upward toward the surface.

BRIEF DESCRIPTION OF THE DRAWINGS

Illustrative embodiments of the present invention are described in detail below with reference to the attached drawing figures, which are incorporated by reference herein and wherein.

Figure 1:
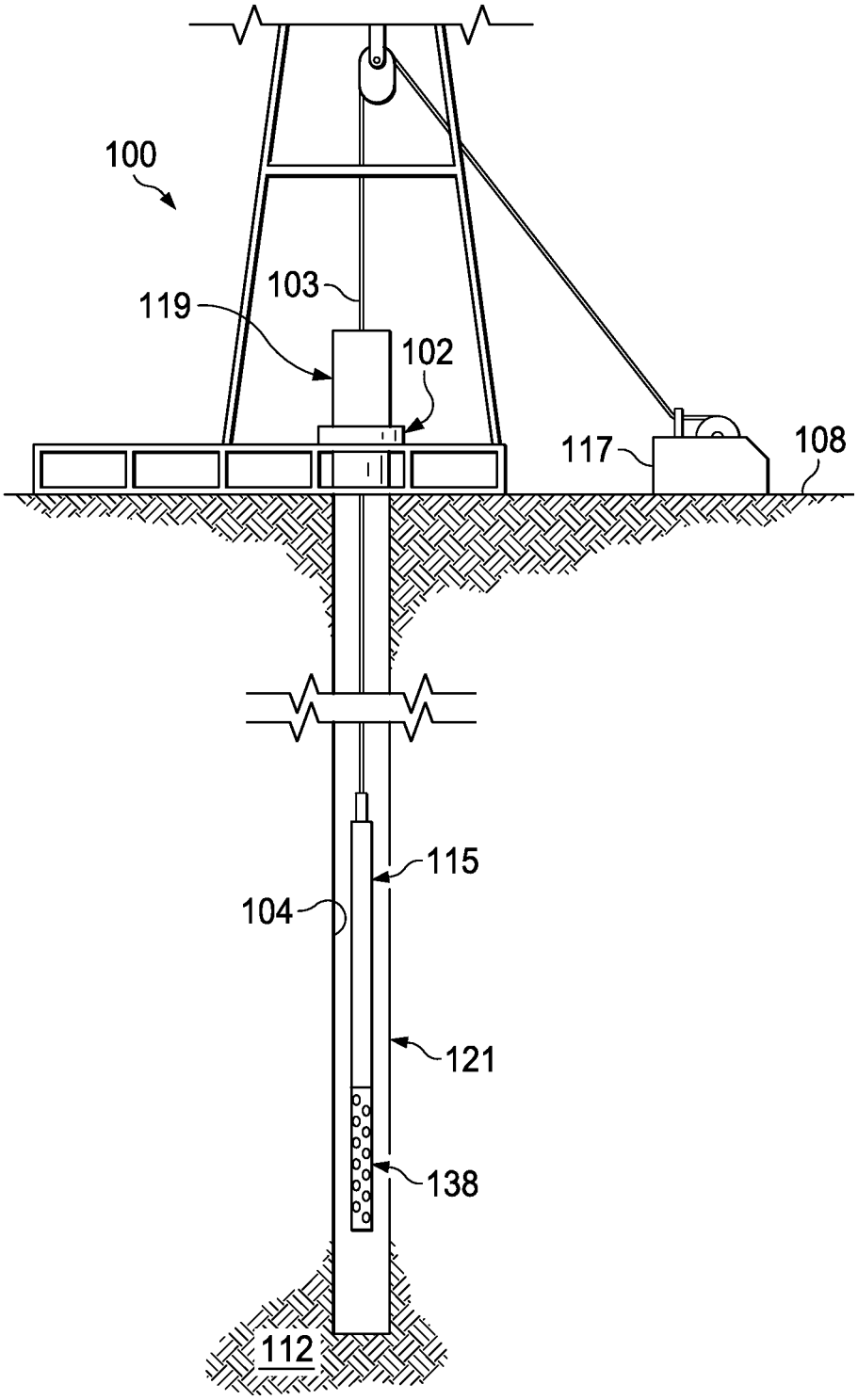
FIG. 1 is a schematic, side view of a tool string having a perforation gun extending into a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention. It is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As noted above, to enable the production of fluids from a well, charges are detonated from a perforation gun to provide openings in the casing and formation through which fluid may flow into the casing. Such openings may be referred to herein as "perforations." These perforations may be created by detonating a plurality of charges located within one or more perforation guns that are deployed within the casing within the hydrocarbon-production formation.

In an embodiment, the perforation guns include a fluidly sealed, enclosed perforation gun housing that includes a coupling to allow the perforation gun to be deployed in the casing by wire line or tubing or a similar conveyance. Each perforation gun includes a plurality of charges deployed within the perforation gun housing on a charge holder that supports the charges and orients the charges such that when the charges are actuated, an explosion will be directed through a desired portion of the perforation gun housing and into the formation. The charges may be shaped charges that constrain the explosive material of the charge in a conical configuration to direct the explosion. Typically, each perforation gun also includes a control cord, or detonation cord, coupled to each charge that actuates the charges. The control cord conveys a mechanical, electrical, or hydraulic control signal that actuates the charges in the event of detonation.

Upon detonation, a detonated charge produces a jet-like explosion that penetrates the perforation gun housing and wall of the casing before forming a tunnel in the formation. In the interest of maximizing the magnitude of the explosion at the formation, resistance to the explosion provided by the perforation gun housing may be reduced by forming scallops in the perforation gun housing adjacent to the charge. As referenced herein, a scallop is a portion of the perforation gun housing that has a reduced wall thickness relative to the nominal thickness of the perforation gun housing. The scallops may be formed in the exterior or interior of a wall that forms the gun body, and may be formed from bands that create reduced-thickness portions about the perimeter of the perforation gun housing or localized reduced-thickness areas formed about the perforation gun housing. The scallops may be formed integrally with the perforation gun housing by milling, casting, or any other suitable method, and may be spaced about the perforation gun housing at locations that correspond to the intended explosion path of a charge. The scallops may be circular, oval, or any other suitable shape.

Removing material from the perforation gun housing, however, may have the unintended consequence of weakening the housing (and the corresponding perforation gun)

or changing the properties of the material that forms the perforation gun housing. For example, where the perforation gun housing is a metal, a machined area of the housing and areas bordering the machined area may be subject to internal stresses induced by the machining process. Such induced stresses may result in susceptibility to cracking or excessive deformation of the perforation gun housing when a charge is detonated, including swelling, fracture, crack propagation, catastrophic rupturing or splitting of the perforation gun housing.

Such fracture or excessive deformation may result in the perforation gun housing becoming stuck in the well or disconnected from the tool string, which may in turn cause the operator to fish fractured portions of the perforation gun housing from the casing before production can begin. This process may delay production and result in increased costs to the well operator.

To address the issue of unwanted cracking, fracture or deformation at the scallop, the present disclosure introduces a perforation gun housing that is selectively annealed at or near the scallops to enhance the mechanical properties of the housing material by, for example, improving fracture strength of the housing at the annealed location.

Where the gun housing is constructed of a high-strength material, such as Grade A steel, alloy steel, stainless steel, or a chromium or super chromium grade stainless steel alloy (13CrM and 13CrS), the steel may be thermomechanically processed to have a selected strength level. However, there is generally an inverse relationship between yield strength and fracture toughness, such that as the yield strength increases, the fracture toughness decreases. At the location of a detonation, which may generally be considered to be the location of a scallop, however, it may be beneficial to have an increased fracture strength to enhance the gun housing's resistance to fracture and crack propagation when the housing is subjected to static stresses or dynamic loads resulting from the detonation of a charge. This trade-off of mechanical properties, however, may not result in improved performance of the remaining portion of the gun body, which has an increased thickness to make up for a lower fracture strength and to provide increased yield strength that enables the housing to withstand the detonation and static loads without failing. To preserve the overall mechanical properties of the gun housing while modifying the mechanical properties of material at the scallops, processes are described below for localized thermomechanical processing that affects only housing material at or very near the scallops.

Referring now to the figures, FIG. 1 shows a schematic view of a well 100 in which a bore hole 104 extends from the surface 108 through a geological formation 112 that is expected to produce hydrocarbons. A perforation string 115, which includes one or more perforation guns 138, has been deployed within the wellbore 104 by wireline 103 and is coupled to a control system 119 at the sealed well head 102. As shown in FIG. 1, the perforation string 115 is lowered into a casing 121 that has been cemented into the formation 112 by a winch 117 that lowers and raises the perforation string 115 within the wellbore 104. While FIG. 1 depicts a land-based rig 106 from which the perforation string 115 is deployed, it is noted that the perforation string 115 may be similarly deployed from a floating platform in the case of a subsea well or from another type of conveyance. Similarly, while FIG. 1 shows a vertical well it is noted that the perforation string may be similarly deployed in other well configurations, including multilateral wells, horizontal wells, inclined wells, and deviated wells.

Figure 2:
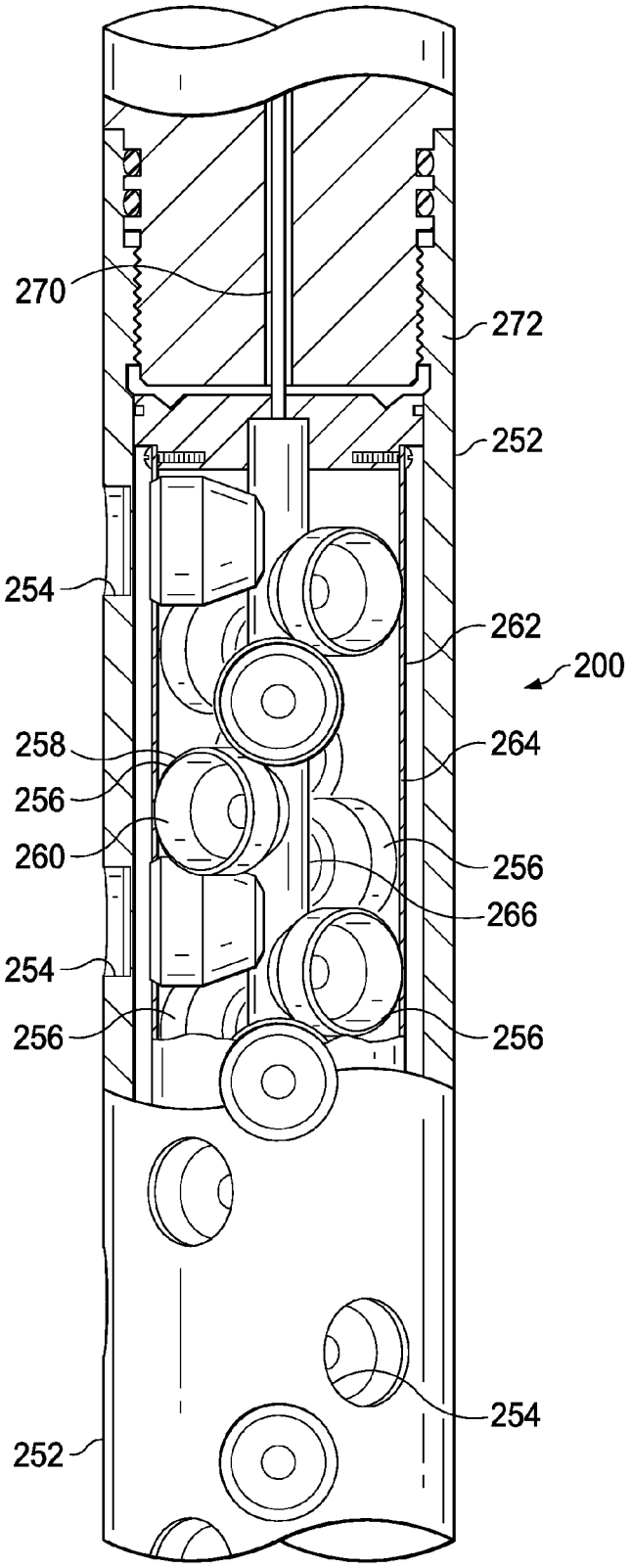
FIG. 2 is a schematic, side view, in partial cross section, of a perforation gun and housing that includes a plurality of scallops.

FIG. 2 shows a perforation gun 200 that is analogous to the perforation gun 138 shown in FIG. 1. The perforation gun 200 includes a perforation gun housing 252, which may be a cylindrically shaped housing having a wall 272 of a nominal thickness t. The perforation gun housing may be formed from a steel alloy or any other suitable material, including the types of steel and steel alloys listed above. In an embodiment, the perforation gun housing 252 includes a plurality of scallops 254 which may be understood to be recesses or reduced-thickness areas of the perforation gun housing 252. The perforation gun 200 includes charges 256 that are substantially radially aligned with the scallops 254 to direct an explosion emanating from the charges 256 through the scallops 254 upon detonation. Each charge 256 is shown as having a frustoconical shape and includes an outer housing 258, liner 260, and an explosive composition disposed therein. When the perforation gun 200 is actuated, the liners 260 of the charges 256 form jets that pass through the scallops 254 and form perforations or tunnels that extend outwardly through the perforation gun, casing, and a desired depth into the adjacent formation.

The perforation gun 200 includes a charge support structure 262 that holds the charges 256 in place within the perforation gun housing 252 at a desired location. The charge support structure 262 includes an outer sleeve 264 and an inner sleeve 266 that enclose the charges 256. In an embodiment, the outer sleeve 264 supports the outer, open ends of the charges 256 and the inner sleeve 266 supports the opposing, conical end of the charges 256, which may also be referred to as the initiation ends. A detonator control line 270, which may be formed from, for example, Primacord, is disposed within the inner sleeve 266 and operable to actuate the charges 256 to cause detonation. In an embodiment, the initiation ends of the charges 256 extend toward the center of the perforation gun to intersect with and connect to the detonator control line 270 via an opening in the inner sleeve 266.

As noted above, each charge 256 is longitudinally and radially aligned with a scallop 254 when the perforation gun 200 is assembled. The charges 256 may be arranged in a helix so that each charge 256 has a unique height relative to the end of the perforation gun 200 or any other suitable configuration. For example, the charges may be arranged in a cluster or in bands so that multiple perforations may be formed at the same longitudinal distance from the end of the perforation gun. The perforation gun 200 may be configured so that the charges 256 detonate one at a time, in unison, or as subsets that detonate in unison.

To prevent undesired fracture, cracking, or excessive deformation of the perforation gun housing 252 during detonation, each of the scallops 254 and areas adjacent the scallops may be treated to resist or arrest cracking without altering the mechanical properties of the perforation gun housing 252 as a whole. Such a process may be referred as "selective annealing." In an embodiment, the selective annealing process is applied to the scallops 254 to cause the perforation gun housing material at the scallops to have mechanical properties that are different from other portions of the perforation gun housing 252. Such mechanical properties may include increased fracture strength at the scallops 254 so that the gun housing 252 does not crack or otherwise fail upon detonation of an adjacent charge 256.

Figure 3:
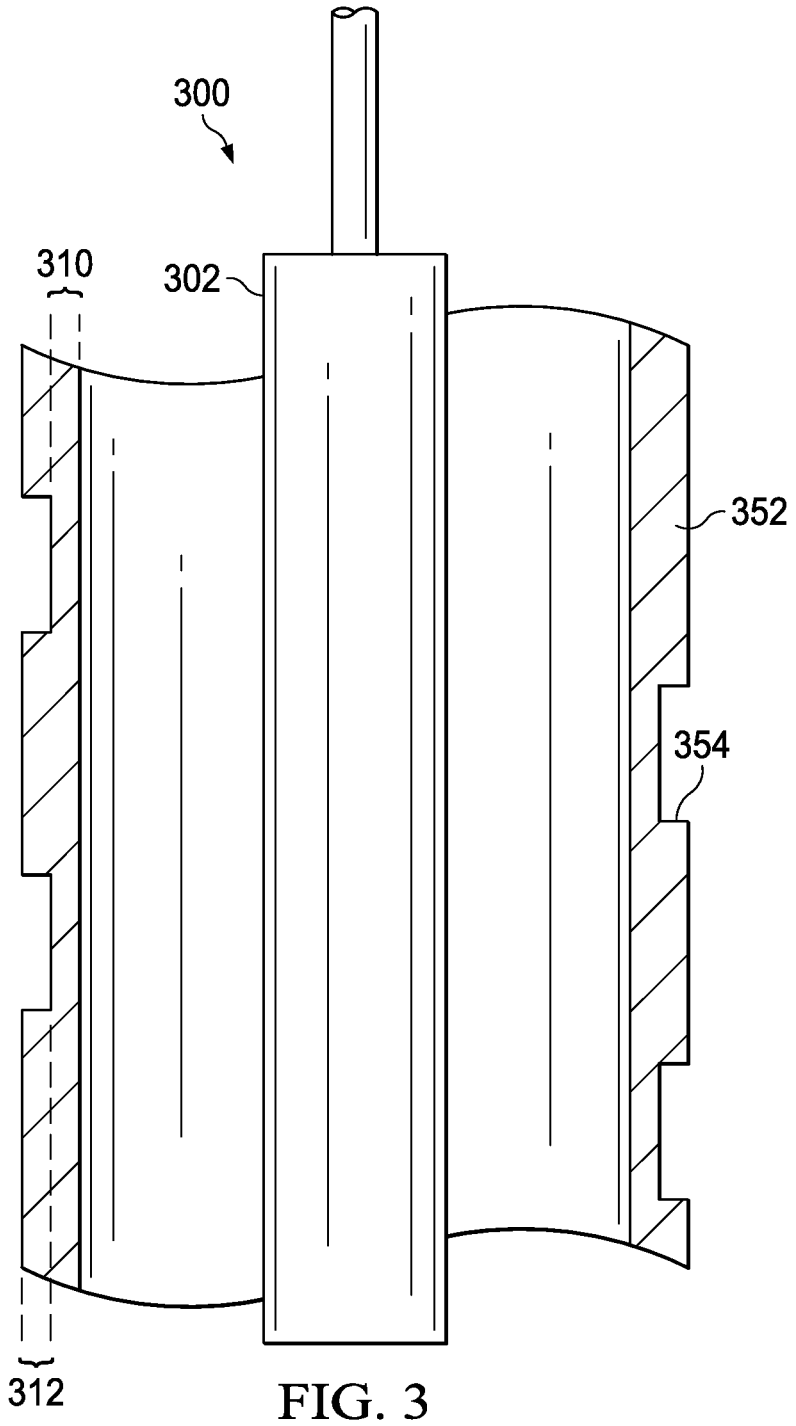
FIG. 3 is a schematic, side view of an illustrative method of selectively annealing a perforation gun housing that includes the insertion of a heating element.

FIG. 3 shows a system 300 for applying a selective annealing treatment to a perforation gun housing 352 to enhance the mechanical properties of the perforation gun housing 352 at the scallops 354 without substantially affecting the mechanical properties of other regions of the perforation gun housing 352. The system 300 includes a heating element 302, which may be an inductive heating element that is deployed within the perforation gun housing 352 to anneal an interior portion of the perforation gun housing 352. In an embodiment, the inductive heating element is an induction coil, such as a single-turn or two-turn scanning coil with a core composed of high-frequency magnetic material, such as Ferrotron 559H. Other types of heating elements that may be used include other cylindrical single and multi-turn coils, hairpin coils, and central rod coils. To facilitate control of the annealing process, the inductive heating element may also include a conduit for supplying cooling fluid, or quenchant, to the surface to be annealed. In an embodiment, the inductive heating element may be sized and configured to anneal an area that is the size of a single scallop.

As shown in FIG. 3, the heating element 302 may be operated to affect only an interior layer 310 of the perforation gun housing 352 by controlling the magnitude of the heat provided by the heating element, distance from the interior surface of the perforation gun housing 352, and the ambient conditions to which the external surface of the perforation gun housing 352 is subjected. By limiting the extent to which an exterior layer 312 of the perforation gun housing 352 is affected, the perforation gun housing 352 may be selectively annealed.

FIG. 3 shows that the thickness of the interior layer 302 roughly corresponds to the thickness of the perforation gun housing 352 at the scallops 354. In such an embodiment, the exterior layer 312 may avoid being subject to the annealing treatment by cooling the exterior layer 312 or by limiting the amount of heat that is supplied by the heating element 302.

In an embodiment, the heating element 302 uniformly heats the interior layer 310 of the perforation gun housing. In another embodiment, however, the heating element 302 may be thermally masked by, for example, applying an insulating layer to portions of the heating element, so that the heating element 302 only applies heat to the scallops 354. For example, a plurality of smaller heating elements 302 may be placed at or near the scallops 354 to limit the extent to which heat is applied to the surrounding portion of the scallops 354. In another, similar embodiment, a heating element 302 may have an insulating layer that includes apertures that correspond to the locations of the scallops 354 within the perforation gun housing 352 so that heat will only be applied to the perforation gun housing 352 at the locations of the scallops 354. In an embodiment, the selective annealing process may result in the perforation gun housing material being subject to increased temperatures at the scallops 354 for an extended period of time. For example, where the perforation gun housing is formed from steel, the material may be heated to a temperature of 595-740° C. a period of two hours.

Figure 4:
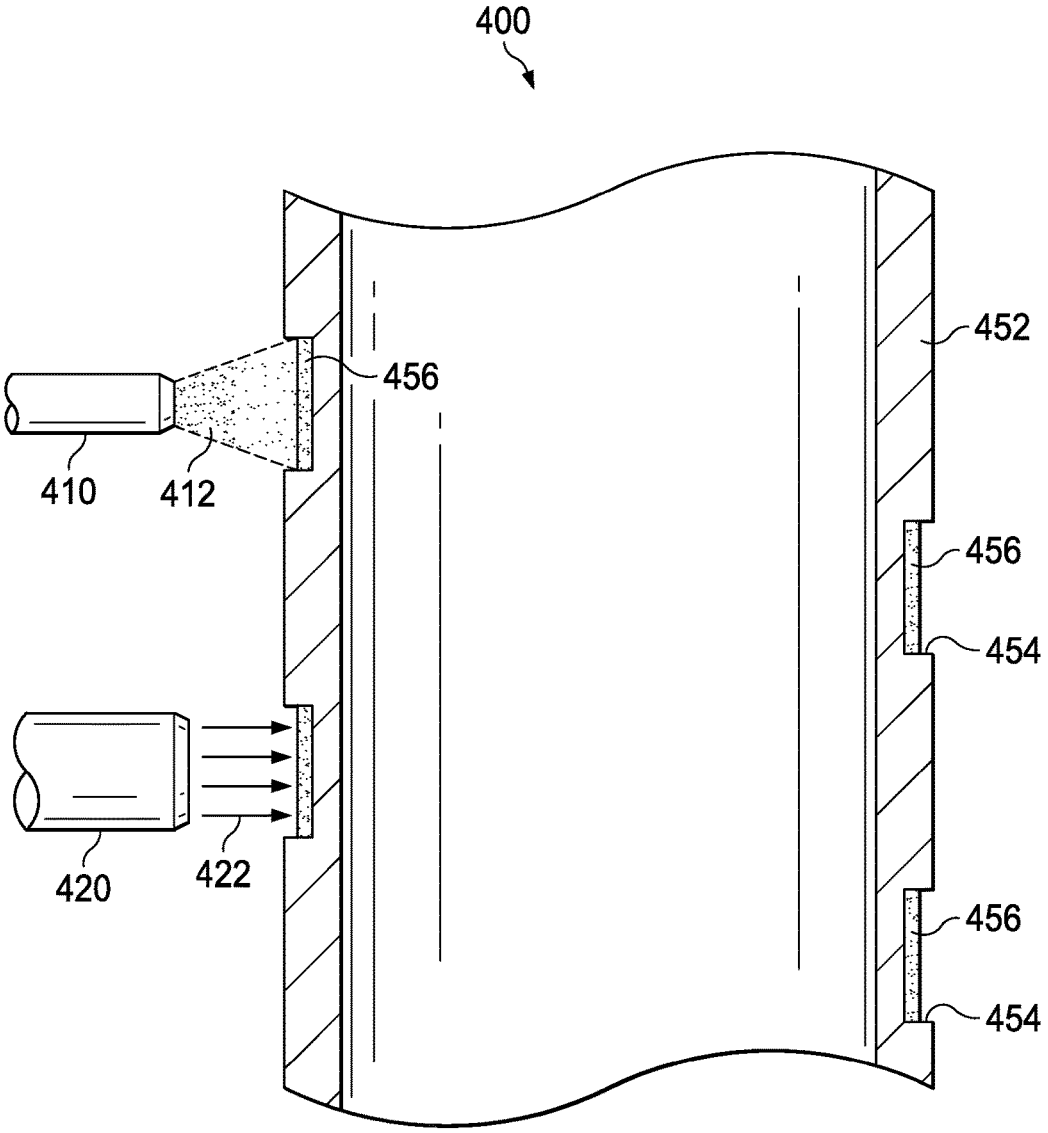
FIG. 4 is a schematic, side view of an illustrative method of selectively annealing a perforation gun housing that includes applying a coating to at least one of a plurality of scallops and applying a laser to the coating to selectively anneal the scallop.

FIG. 4 shows another system 400 for applying a selective annealing treatment to a perforation gun housing 452 to enhance the mechanical properties of the perforation gun housing 452 at the scallops 454 without substantially affecting the mechanical properties of the other regions of the perforation gun housing 452. The system 400 includes a nozzle 410 to apply a spray 412 that forms a layer 456 of an annealing material, which may also be referred to as a coating. The annealing material layer 456 or coating may be selected and configured to heat when subjected certain stimuli, such as, for example, a laser. In the embodiment of FIG. 4, the layer 456 may be a phosphate layer that heats in response to a laser 420 being applied to the scallops 454, as indicated by the arrows 422.

In the event of such laser-induced heat treatment, energy is transmitted to the perforation gun housing material to create a hardened layer. Allowing or assisting the adjacent regions of the scallops 454 to dissipate heat (for example, by heat sinking) and self-quench, resulting in a hardened layer 456 of material at the scallop.

In an embodiment, the laser 410 is a carbon dioxide or Nd:YAG (neodymium-doped yttrium aluminum garnet) laser that provides power levels in the 500-2000 watt range for heat treating, and the perforation gun housing 452 is formed from one or more common steels or stainless steels. In an embodiment in which the perforation gun housing 452 is formed from low carbon steel (0.08% to 0.30% carbon), the perforation gun housing 452 may be rapidly quenched to form martensite in low carbon steel at a shallow depth of up to 0.5 mm. In an embodiment in which the perforation gun housing 452 if formed from medium or high carbon steel (0.35% to 0.80% carbon) longer quenching periods may be used to increase hardness. Where increased hardness is not desired, the laser may be pulsed to allow for the slower cooling of the treated area to avoid self-quenching. It is noted that in certain embodiments in which the selective annealing process may result in, for example, increased fracture strength, the selective annealing process may be applied to the scallops and the portions of the housing adjacent the scallops 454 to prevent and arrest cracking of the perforation gun housing 452. In an embodiment in which the perforation gun housing 452 is formed from alloy or tool steel, the laser treatment may result in a treatment depth of up to 3 mm or more. However, the laser treatment process may be configured to control the depth of the layer of material that is affected by the treatment process.

In an embodiment in which the laser is a CO2 laser, a the layer 456 may be a phosphate or black paint layer 456 that is applied to the scallop (or all areas other than the scallop) to enhance the absorptivity of the perforation gun housing material in response to illumination by the laser beam. Broadly, however, this concept may be applied to any of the selective annealing treatments described herein, as each of the selective annealing processes and systems described may be applied to substantially the entire perforation gun housing 452 except for the scallops 454.

Figure 5:
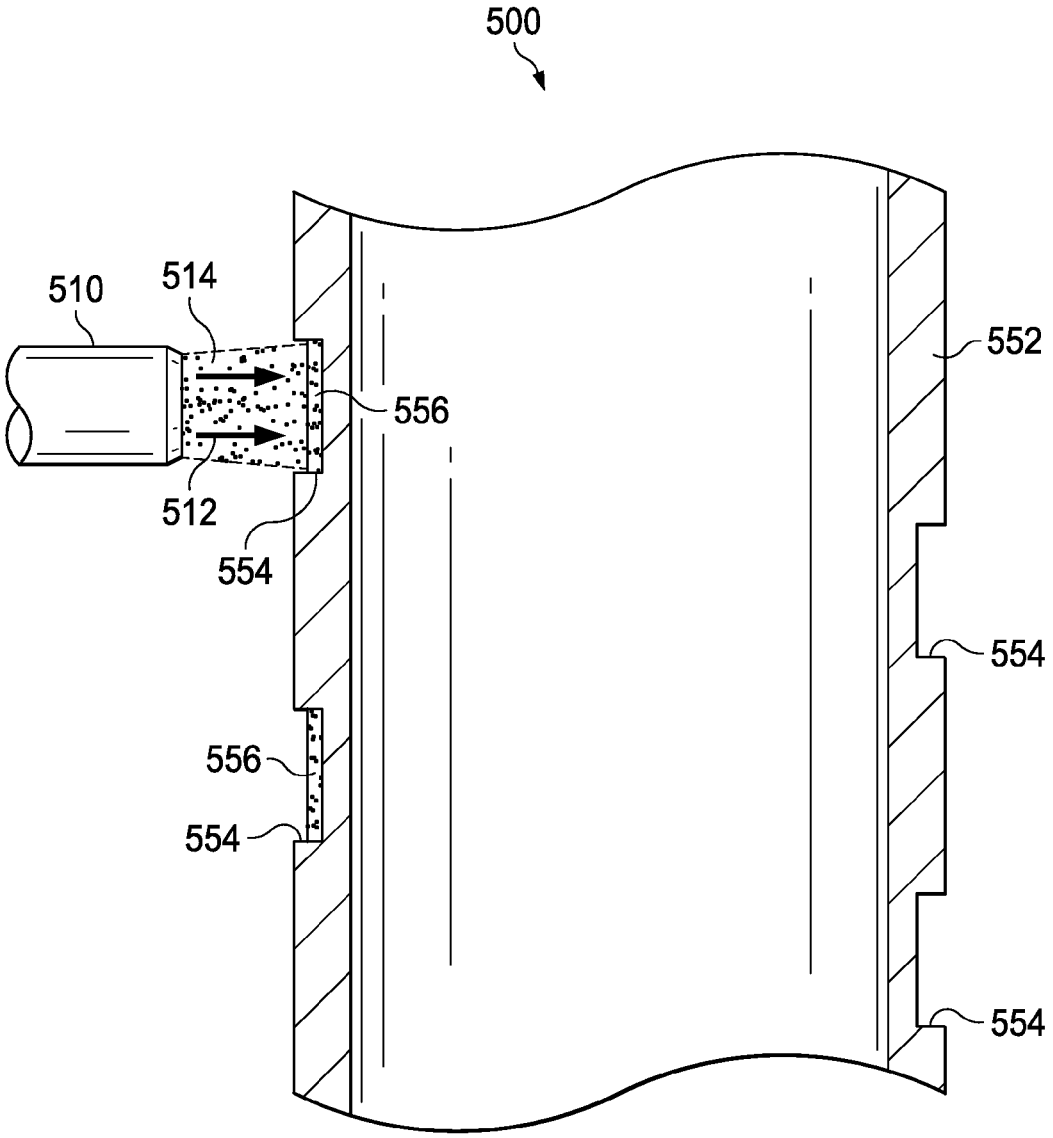
FIG. 5 is a schematic, side view of an illustrative method of selectively annealing a perforation gun housing that includes shot peening at least one of a plurality of scallops formed in the gun housing.

FIG. 5 shows another illustrative system 500 for applying a selective annealing treatment to a perforation gun housing 552 to enhance the mechanical properties of the perforation gun housing 552 at the scallops 554 without substantially affecting the mechanical properties of the other regions of the perforation gun housing 552. The system 500 includes a shot-peening system 510 that peens the scallops 554 with shot 514 to induce compressive stresses at a surface 556 that is subject to the shot peening, as indicated by the arrows 512. These compressive stresses may improve the fracture strength of the scallops by arresting or preventing cracks from propagating in the gun housing 552.

In addition to the selective annealing processes described above, hybrid processes may also be employed to selectively anneal the scallops and adjacent areas. For example, laser peening, which may also be referred to as "laser shot peening", is a process of hardening or peening metal using a powerful laser that may be used to selectively anneal the gun housing 552. Comparable to shot peening, laser peening can impart a layer of residual compressive stress on a surface that is deeper than that attainable from conventional shot peening treatments. In a typical laser-peening process, an ablative coating is applied to the area to be treated to absorb energy provided by the laser. The coating may be a black paint or tape. To treat the material, short pulses of the laser are delivered to the coating to cause micro-explosions that induce compressive stresses in the treated material. The laser may be applied from multiple angles to create indentations from a variety of trajectories. The process may be repeated as desired to treat the material to a desired depth, which is generally 1 to 2 mm. In addition, where heat sources such as inductive heating elements or lasers are employed, other heat sources may be used in their place to supply heat for the annealing process. Any high density energy source that is suitable for applying energy to the surface of the gun housing 552, such as, for example, an e-beam, may also be used to provide heat for the annealing process.

In view of the foregoing disclosure, an illustrative process for manufacturing a perforation gun casing includes providing a perforation gun housing that has a wall of nominal wall thickness and at least one scallop. Each scallop forms a portion of the wall having a reduced thickness relative to the nominal wall thickness. The illustrative process includes applying a selective annealing process to the perforation gun casing. The selective annealing process affects the material properties of the scallop and does not substantially affect the material properties of the portions of the wall having a nominal thickness. The selective annealing process may include (1) annealing the inner diameter of the perforation gun casing to a depth that substantially affects only the scalloped areas of the gun casing; (2) applying a coating, such as, for example, a phosphate coating, to an inner or outer surface of the scallop that heats in response to being illuminated by a laser; (3) providing an induction coil or similar heating element adjacent the scallop and heating the scallop with the induction coil or heating element; (4) shot peening or laser peening the scallop; or (5) any combination of the foregoing.

According to another illustrative embodiment, a perforation gun includes a gun housing having a plurality of selectively annealed scallops spaced radially about the gun housing. Each selectively annealed scallop forms a reduced-thickness portion of the gun body. The gun includes a charge holder positioned within the gun housing and a plurality of charges coupled to the charge holder. Each charge has a discharging end and a non-discharging end, and each discharging end of each of the plurality of charges is oriented to discharge through the gun body at one of the plurality of scallops. The selectively annealed scallops may be formed by any of the following selective annealing processes: (1) annealing the inner diameter of the perforation gun casing to a depth that substantially affects only the scalloped areas of the gun casing; (2) applying a coating, such as, for example, a phosphate coating, to an inner or outer surface of the scallop that heats in response to being illuminated by a laser; (3) providing an induction coil or similar heating element adjacent the scallop and heating the scallop with the induction coil or heating element; (4) shot peening or laser peening the scallop; or (5) any combination of the foregoing.

According to another illustrative embodiment, a method of manufacturing a perforation gun assembly includes providing a gun housing having a plurality of selectively annealed scallops spaced radially about the gun housing. Each selectively annealed scallop includes a reduced-thickness portion of the gun body. The method also includes providing a charge holder positioned within the gun housing. The method may also include (1) annealing an inner surface of the gun housing; (2) applying a coating, such as a phosphate coating that heats in response to being subjected to a laser or a particular wavelength of light, to each of a plurality of scallops; (3) placing an induction coil adjacent each of a plurality of scallops and heating each scallop with the induction coil; (4) shot peening or laser peening a plurality of scallops; or (5) any combination of the foregoing.

The illustrative systems, methods, and devices described herein may also be described by the following examples:

Example 1

A process to manufacture a perforation gun casing, the process comprising: providing a perforation gun housing comprising a wall having a nominal wall thickness and at least one scallop defining a portion of the wall having a reduced thickness relative to the nominal wall thickness; and applying a selective annealing process to the perforation gun casing to change a material property of the portion of the wall at the at least one scallop but not substantially change the material property of a second portion of the wall having the nominal thickness.

Example 2

The process of example 1, wherein applying a selective annealing process comprises annealing an inner diameter of the perforation gun casing.

Example 3

The process of any of examples 1 or 2, wherein applying a selective annealing process comprises applying a coating to the scallop.

Example 4

The process of example 3, wherein applying the coating further comprises heating the coating in response to being illuminated by a laser.

Example 5

The process of example 4, wherein the coating is a phosphate coating.

Example 6

The process of any of examples 1-5, wherein applying a selective annealing process comprises providing an induction coil adjacent the scallop and heating the scallop with the induction coil.

Example 7

The process of any of examples 1-6, wherein applying a selective annealing process comprises shot peening the scallop.

Example 8

A perforation gun comprising:

a gun housing having a plurality of selectively annealed scallops spaced radially about the gun housing, each selectively annealed scallop defining a reduced-thickness portion of the gun housing;

a charge holder positioned within the gun housing; and a plurality of charges coupled to the charge holder, each charge having a discharging end and a non-discharging end;

wherein each discharging end of each of the plurality of charges is oriented to discharge through the gun housing at one of the plurality of selectively annealed scallops.

Example 9

The perforation gun of example 8, wherein each of the selectively annealed scallops is formed from annealing an inner surface of the gun housing.

Example 10

The perforation gun of any of examples 8 or 9, wherein each of the selectively annealed scallops comprises a coating.

Example 11

The perforation gun of example 10, wherein the coating comprises a material that heats in response to being subjected to a particular wavelength of light.

Example 12

The perforation gun of example 11, wherein the coating comprises a phosphate.

Example 13

The perforation gun of any of examples 8-12, further comprising an induction coil adjacent at least one of the plurality of selectively annealed scallops to heat the scallop.

Example 14

The perforation gun of any of examples 8-13, wherein each of the selectively annealed scallops comprises a shot-peened surface.

Example 15

A method of perforating a formation comprising:

providing a perforation gun assembly having:

a gun housing having a plurality of selectively annealed scallops spaced radially about the gun housing, each selectively annealed scallop defining a reduced-thickness portion of the gun housing; and a charge holder positioned within the gun housing, the charge holder positioning at least one charge adjacent each scallop and oriented to direct an explosion through each scallop;

positioning the perforation gun assembly in a wellbore; and detonating the charges.

Example 16

The method of example 15, wherein each of the selectively annealed scallops comprises an annealed inner surface of the gun housing.

Example 17

The method of any of examples 15 or 16, wherein each of the selectively annealed scallops comprises a coating.

Example 18

The method of example 17, wherein the coating comprises a phosphate that heats in response to being subjected by a particular wavelength of light.

Example 19

The method of any of examples 15-18, wherein each of the selectively annealed scallops comprises a heat-treated material.

Example 20

The method of any of examples 15-19, wherein each of the selectively annealed scallops comprises a shot-peened surface.

Example 21

The method of any of examples 15-20, wherein each of the selectively annealed scallops comprises a laser shot-peened surface.

Example 22

The perforation gun of any of examples 8-14, wherein each of the selectively annealed scallops comprises a laser shot-peened surface.

Example 23

The process of any of examples 1-7, wherein applying a selective annealing process comprises laser-shot peening the scallop.

It should be apparent from the foregoing that an invention having significant advantages has been provided. While the invention is shown in only a few of its forms, it is not limited to only these embodiments but is susceptible to various changes and modifications without departing from the spirit thereof.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described to explain the principles of the invention and the practical application and to enable others of ordinary skill in the art to understand the invention for various embodiments with various modifications as are suited to the particular use contemplated. The scope of the claims is intended to broadly cover the disclosed embodiments and any such modification.

We claim:

1. A process to manufacture a perforation gun casing, the process comprising:

providing a tubular perforation gun housing comprising a wall having a nominal wall thickness and at least one scallop defining a portion of the wall having a reduced thickness relative to the nominal wall thickness; and applying a selective heating and cooling annealing process to the perforation gun casing to change a material property of the portion of the wall at the at least one scallop but not substantially change the material property of a second portion of the wall having the nominal thickness.

2. The process of claim 1, wherein applying the selective annealing process comprises annealing an inner diameter of the perforation gun casing.

3. The process of claim 1, wherein applying the selective annealing process comprises applying a coating to the scallop.

4. The process of claim 3, wherein applying the coating further comprises heating the coating in response to being illuminated by a laser.

5. The process of claim 4, wherein the coating is a phosphate coating.

6. The process of claim 1, wherein applying the selective annealing process comprises providing an induction coil adjacent the scallop and heating the scallop with the induction coil.

7. The process of claim 1, wherein applying the selective annealing process further comprises shot peening the scallop.

8. A perforation gun comprising:

a tubular gun housing having a plurality of selectively heated and cooled annealed scallops spaced radially about the gun housing, each selectively annealed scallop defining a reduced-thickness portion of the gun housing;

a charge holder positioned within the gun housing; and a plurality of charges coupled to the charge holder, each charge having a discharging end and a non-discharging end;

wherein each discharging end of each of the plurality of charges is oriented to discharge through the gun housing at one of the plurality of selectively annealed scallops.

9. The perforation gun of claim 8, wherein each of the selectively annealed scallops is formed from annealing an inner surface of the gun housing.

10. The perforation gun of claim 8, wherein each of the selectively annealed scallops comprises a coating.

11. The perforation gun of claim 10, wherein the coating comprises a material that heats in response to being subjected to a particular wavelength of light.

12. The perforation gun of claim 11, wherein the coating comprises a phosphate.

13. The perforation gun of claim 8 further comprising an induction coil adjacent at least one of the plurality of selectively annealed scallops to heat the scallop.

14. The perforation gun of claim 8, wherein each of the selectively annealed scallops further comprises a shot-peened surface.

15. A method of perforating a formation comprising:

providing a perforation gun assembly having:

a tubular gun housing having a plurality of selectively heated and cooled annealed scallops spaced radially about the gun housing, each selectively annealed scallop defining a reduced-thickness portion of the gun housing; and a charge holder positioned within the gun housing, the charge holder positioning at least one charge adjacent each scallop and oriented to direct an explosion through each scallop;

positioning the perforation gun assembly in a wellbore; and detonating the charges.

16. The method of claim 15, wherein each of the selectively annealed scallops comprises an annealed inner surface of the gun housing.

17. The method of claim 15, wherein each of the selectively annealed scallops comprises a coating.

18. The method of claim 17, wherein the coating comprises a phosphate that heats in response to being subjected by a particular wavelength of light.

19. The method of claim 15, wherein providing a gun housing further comprises shot peening the selectively annealed scallops.

* * * * *